US005862956A

United States Patent [19]

Brandenburg et al.

[11] Patent Number: 5,862,956

[45] Date of Patent: Jan. 26, 1999

[54] DISPENSING SYSTEM FOR FLOWABLE LIQUIDS

[75] Inventors: Allen Eugene Brandenburg, Austin; John Ethan Maldonado, San Antonio, both of Tex.

[73] Assignee: Kimberly-Clark Worldwide, Inc., Neenah, Wis.

[21] Appl. No.: 882,886

[22] Filed: Jun. 26, 1997

[51] Int. Cl.[6] ..... B65D 37/00; B67D 5/06

[52] U.S. Cl. ..... 222/214; 222/207; 222/183; 222/182

[58] Field of Search ..... 222/181.2, 182, 222/183, 207, 214

[56] References Cited

U.S. PATENT DOCUMENTS

| | | | |
|---|---|---|---|
| 3,741,439 | 6/1973 | Vehrs | 222/214 |
| 4,130,224 | 12/1978 | Norman et al. | 222/214 |
| 4,621,749 | 11/1986 | Kanfer | 222/181.2 |
| 4,792,064 | 12/1988 | Loesel, Jr. et al. | 222/181.2 |
| 5,261,557 | 11/1993 | Bytell et al. . | |
| 5,265,772 | 11/1993 | Bartasevich et al. | 222/214 |
| 5,431,304 | 7/1995 | Gentile . | |
| 5,464,125 | 11/1995 | Daansen | 222/181.2 |

FOREIGN PATENT DOCUMENTS

| | | |
|---|---|---|
| 97/16107 | 5/1997 | WIPO . |
| 97/17879 | 5/1997 | WIPO . |

OTHER PUBLICATIONS

Counterpart PCT International Search Report mailed Sep. 15, 1998.

*Primary Examiner*—Andres Kashnikow
*Assistant Examiner*—Keats Quinalty
*Attorney, Agent, or Firm*—Karl V. Sidor

[57] ABSTRACT

A dispensing system for flowable liquids that includes a dispensing base for holding a refill package of a flowable liquid. A door is pivotally mounted to the dispensing base by a first pivot so that the door can have an open position and a closed position. The system has a push handle pivotally mounted to the door by a second pivot and a latch integral with the dispensing base to pivotally secure the push handle at the second pivot when the door is closed so that the door is held secure in the closed position and the push handle may be used for dispensing. The dispensing system also includes a release for disengaging the push handle from the latch so that the door may be moved to its open position.

20 Claims, 17 Drawing Sheets

DISPENSING SYSTEM FOR FLOWABLE LIQUIDS

FIELD OF THE INVENTION

This invention generally relates the field of dispensing devices and systems. More particularly, this invention relates to the field of devices and systems for dispensing flowable liquids.

BACKGROUND

Dispensers for flowable liquids such as, for example, liquid soaps and hand cleaners are often provided in many industrial, institutional and commercial environments. These large-capacity dispensers are typically-front-loading and have a door that opens to provide access to a chamber where a liquid refill is installed. Dispensers of this type are equipped with a dispensing handle mounted on the door. A latching mechanism engages the door to a dispenser base. During use, some of the force applied against the dispensing handle to dispense liquid is transferred to the door which is held in place by the latching mechanism.

One disadvantage of many conventional dispensers is that they often have dispensing mechanisms that require more force to operate than is specified under the Americans with Disabilities Act. Unfortunately, simply extending the length of the dispensing handle to maximize leverage also increases the force transferred to the door. In many instances, dispensing becomes unreliable because the force applied to such modified dispensing handles overwhelms the latch mechanism causing the dispenser door to open. For example, instead using a finger to apply force against the dispensing handle, a user might use the heel of the palm of the hand or even a portion of the forearm. The combination of greater force applied by the user and the leverage of the longer handle could easily transfer sufficient force to the dispenser door that the latch mechanism is overwhelmed and the door is sprung open. In addition, the increased force applied to the door causes it to flex. Over time, the flexing of the door causes wear and fatigue that weakens the door and allows even greater distortion and potential failure of the door. Flexing and distortion of the door absorbs force that would otherwise be used to pump or dispense liquid. At sufficient levels of flexing and distortion, the amount or the "shot size" of liquid dispensed is undesirably changed.

Another disadvantage is that large capacity dispensers often hold large liquid refill packages that protrude from the base of the dispenser. The protruding part of these packages are typically reinforced with cardboard, paperboard or similar material. If the exterior of these large liquid refill packages are exposed to excessive moisture or are wetted, the reinforcement becomes ineffective and the package may deform and interfere with reliable dispensing.

A long and unfilled need exists for a flowable liquid dispensing system that is front-loading and requires less force to operate but will provide reliable dispensing. A need also exists for a flowable liquid dispensing system that is front-loading will hold large liquid refill packages in a manner that provides reliable dispensing in wet conditions.

SUMMARY OF THE INVENTION

The problems and needs described above are addressed by the present invention which provides a dispensing system for flowable liquids. The dispensing system includes a dispensing base for holding a refill package of a flowable liquid. A door is pivotally mounted to the dispensing base by a first pivot means so that the door can have an open position and a closed position.

The system has a push handle pivotally mounted to the door by a second pivot means and a latching means integral with the dispensing base to pivotally secure the push handle at the second pivot means when the door is closed so that the door is held secure in the closed position and the push handle may be used for dispensing. Desirably, the latching means is composed of at least one pivot latch.

The dispensing system also includes a release means for disengaging the push handle from the latch means so that the door may be moved to its open position.

In an aspect of the invention, the door may further include latch receptacles located generally opposite the first pivot means and the latching means may further include latching elements integral with the dispensing base to engage the latch receptacles when the door is in the closed position.

The release means may be composed of a release lever mounted to the latching means. Desirably, the release means may further include a return spring and a tab lock so that the latching means are held in an unlocked position when the release lever is depressed and remain in the unlocked position until the door is closed According to an aspect of the invention, the first mounting means may be composed of pivot posts and mounting holes. The second mounting means may also be composed of pivot posts and mounting holes.

In an embodiment of the present invention, the dispensing base may be configured to support the refill package beyond one-half the overall height of the refill package. For example, the dispensing base may be configured to support the refill package to three-quarters of the overall height of the refill package or even to the full height of the refill package.

In another aspect of the present invention, the push handle may include a discrete push surface. The discrete push surface may be set at an angle to permit actuation by the elbow or forearm of a user. Alternatively and/or additionally, the push surface may include a depression which accommodates a finger or thumb of a user for actuation. This depression may be located at any point on the push surface. Desirably, the depression will divide the push surface into substantially equal portions.

In yet another aspect of the present invention, the body of the push handle may be configured to define an opening through which a user may view the portion of the dispenser where liquid is dispensed.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION

Figure 1:
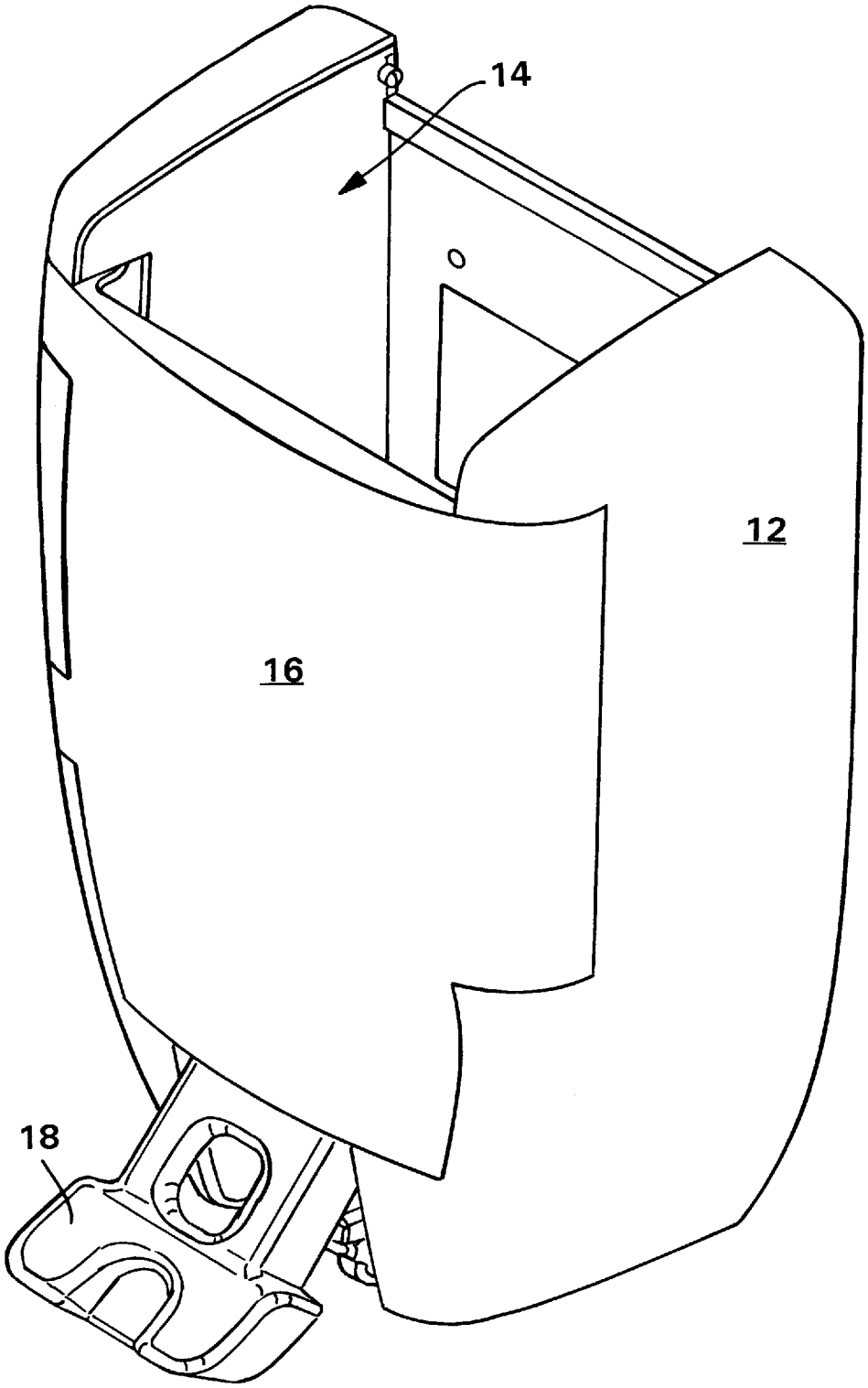
FIG. 1 is a perspective view illustration of an exemplary dispensing system for flowable liquids.
Figure 2:
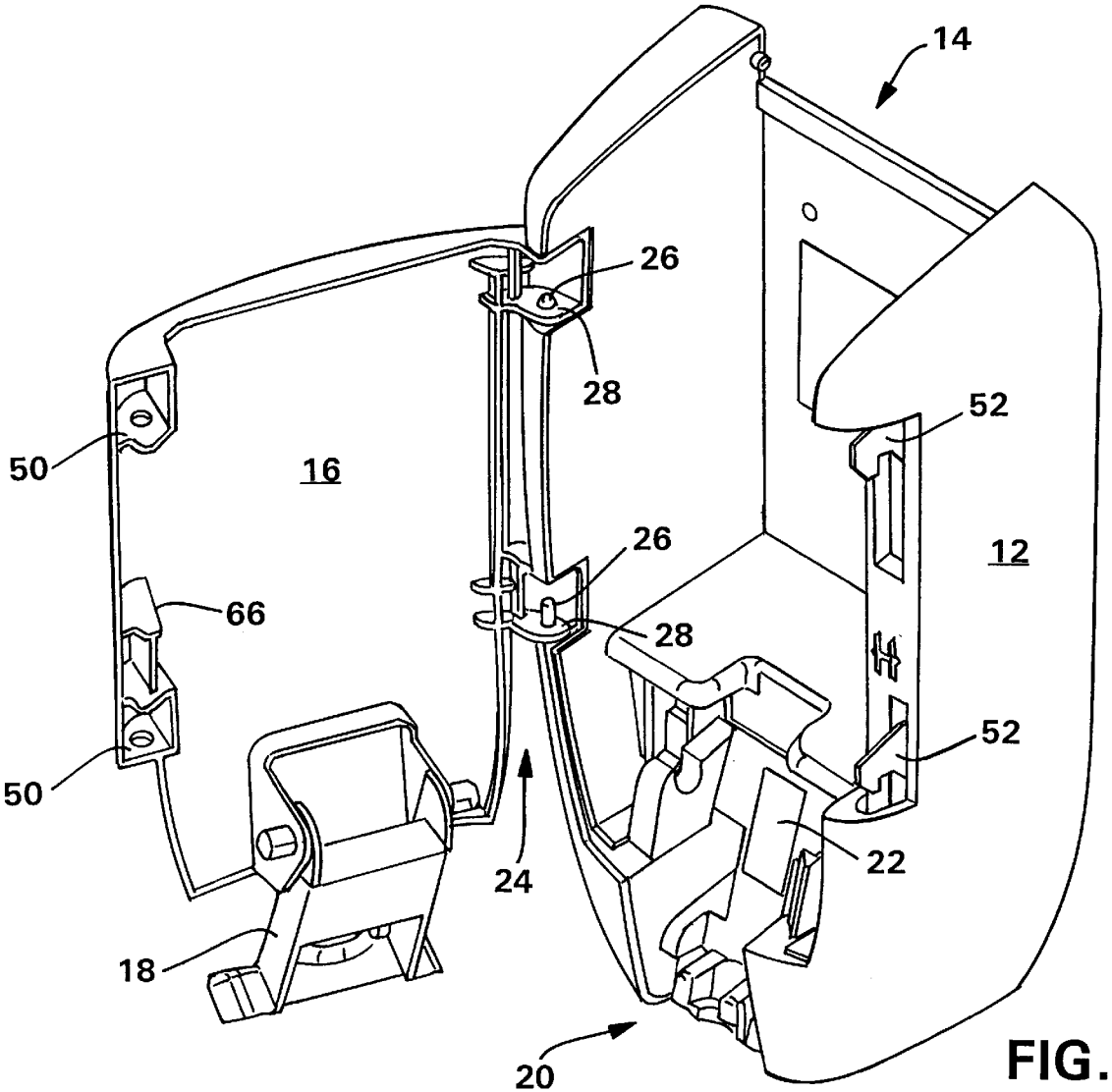
FIG. 2 is a perspective view illustration of an exemplary dispensing system for flowable liquids with the door in an open position.

Referring now to the drawings, wherein like reference numerals designate corresponding structure throughout the views, and referring in particular to FIGS. 1 and 2, there is shown an exemplary dispensing system for flowable liquids.

The system includes an dispensing base 12 defining an interior space 14 that is adapted to contain a refill package of liquid to be dispensed. The dispenser also includes a door 16 that covers the interior space 14. A push handle 18 is mounted to the door 16. The dispensing base is adapted to be mounted to a wall, stand, or fixture by conventional mounting means. When the dispensing base is mounted in such manner, the most convenient and effective access to the dispenser is through the front. This is accomplished by moving the door 16 to an open position as can be seen in FIG. 2.

With the door open, a refill package of liquid may be easily inserted into the interior space 14. A flexible tube component (not shown) of the refill package extends into a pumping area 20. During use, the tube is squeezed between the push handle 18 and a pressure plate 22 as force is applied to the push handle 18. This action causes liquid in the tube to be ejected through a dispensing opening at the bottom of the tube. A more detailed description of this aspect of the dispensing system may be found in, for example, U.S. Pat. No. 3,741,439, entitled "Viscous Liquid Dispenser", issued on Jun. 23, 1973, to Vehns, and U.S. Pat. No. 4,130,224, also entitled "Viscous Liquid Dispenser", issued on Dec. 19, 1978, to Norman et al., the contents of which are incorporated herein in their entirety.

As can be seen in FIG. 2, the door is mounted on the dispensing base by a first pivot means 24. The pivot means may be composed of pivot posts 26 and mounting holes 28. Of course, it is contemplated that other mounting means, including other pivot means, may be used to mount the door 16 to the dispensing base.

Figure 3:
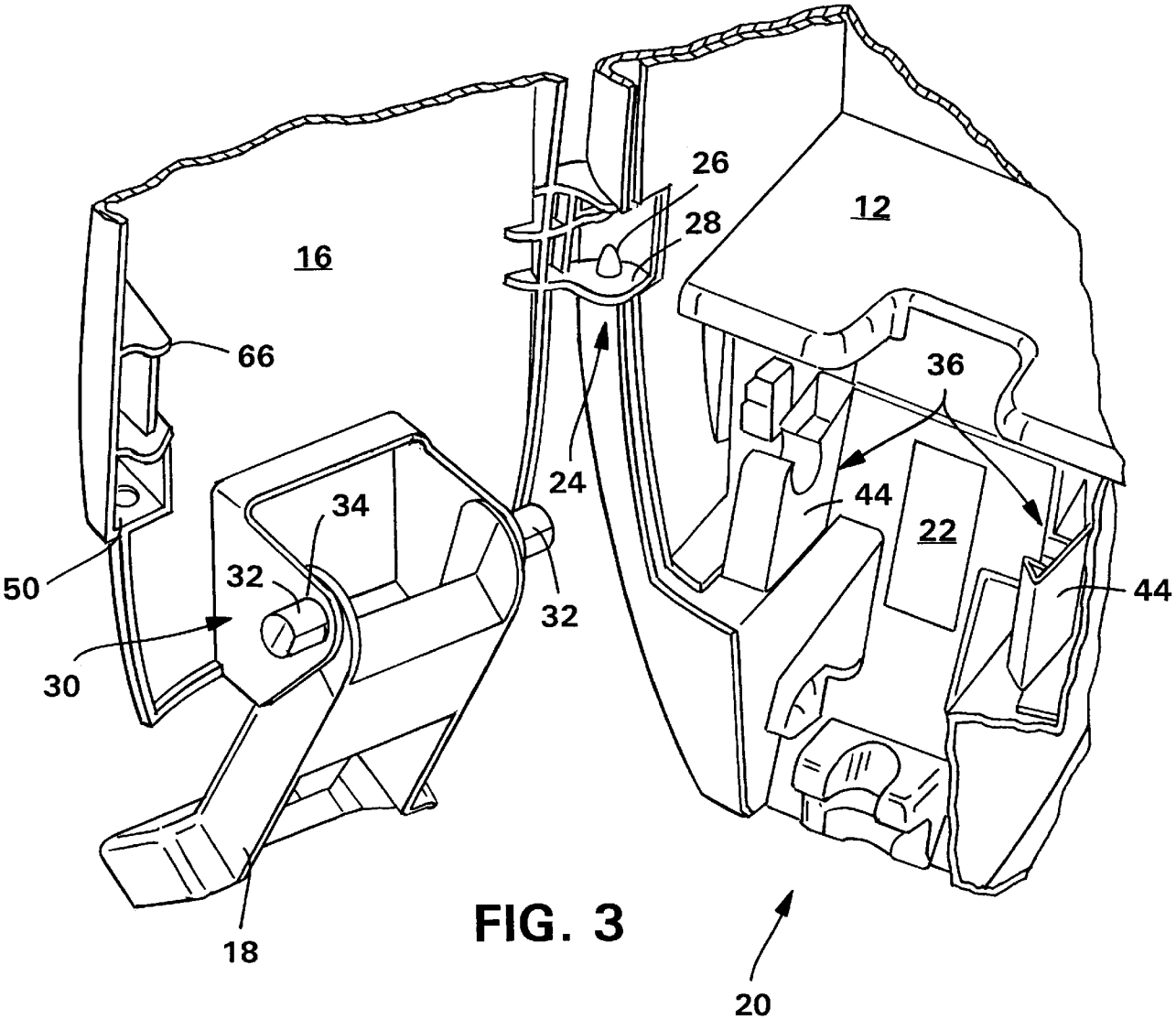
FIG. 3 is a perspective view illustration of an exemplary dispensing system for flowable liquids showing a push handle mounted on the door.

FIG. 3 shows a detail of the push handle 18. As can be seen, the push handle may be mounted onto the door using a second pivot means 30. The pivot means may be composed of pivot posts 32 and mounting holes 34. Of course, it is contemplated that other mounting means, including other pivot means, may be used to mount the push handle 18 to the door 16 so that is able to pivot about the second pivot means.

When the door is closed, the pivot posts 32 of the push handle 18 are pivotally secured by the latching means 36 so that the door is held secure in the closed position and the push handle may be used for dispensing. Desirably, the latching means is composed of at least one pivot latch.

Generally speaking, the latching means are integral with the dispensing base. For purposes of the present invention, the expression "integral with" as it refers to the latching means and the dispensing base refers to the construction or configuration of these two elements such that they could be considered essentially a single structure. This might be accomplished by forming or molding a portion of the latching means out of the dispensing base. Alternatively and/or additionally, this might be accomplished by attaching, welding, screwing, bolting, gluing, bonding or adhering one or more portions of the latching means to the dispensing base so they function essentially as a single structure during use. Of course, it must be understood that the latching means must be able to rotate or move in a manner that allows it to engage the pivot posts 32 that are part of the push handle.

Figure 4:
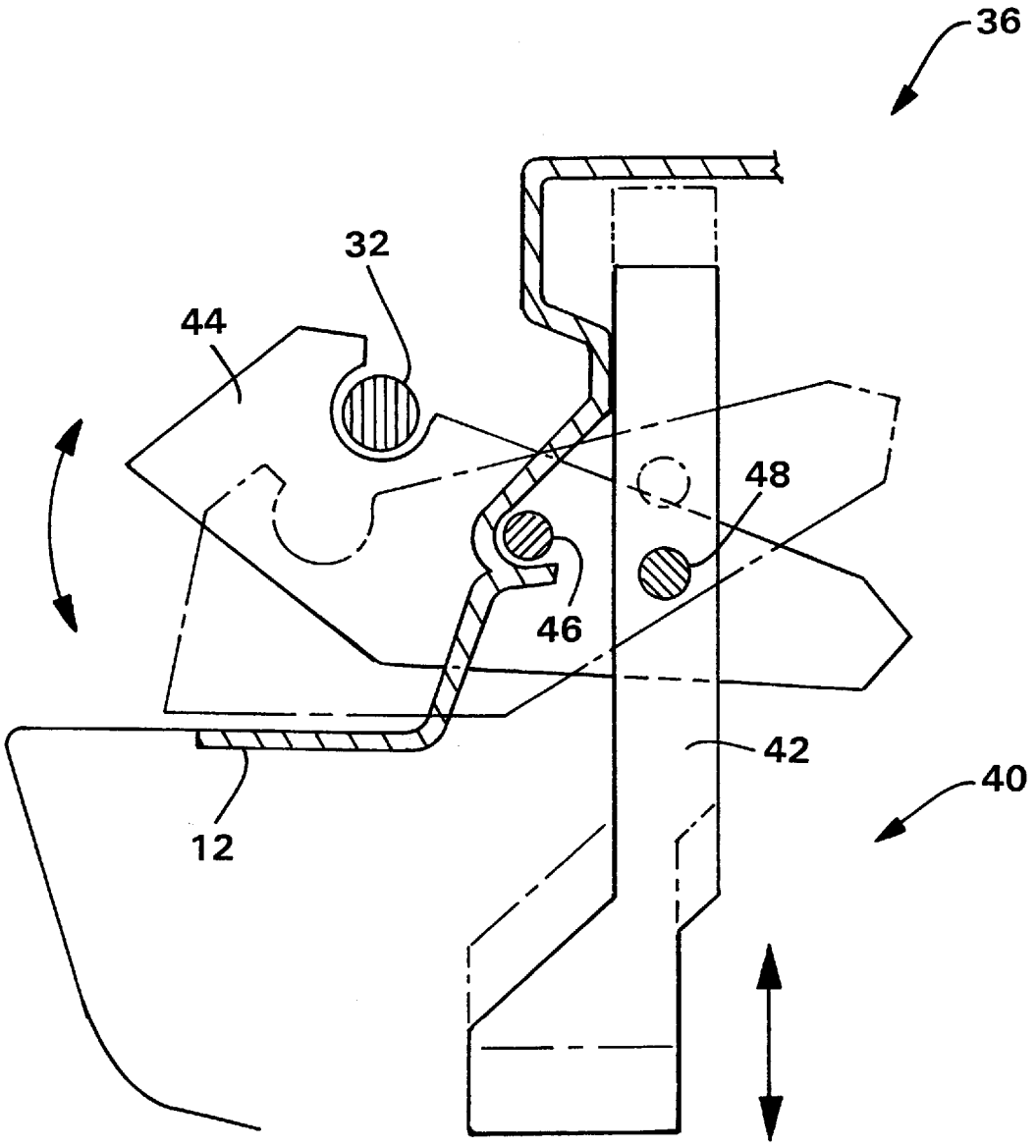
FIG. 4 is a schematic view illustration of a detail of an exemplary dispensing system for flowable liquids.

Referring now to FIG. 4, the dispensing system also includes a release means 40 for disengaging the push handle from the latch means so that the door may be moved to its open position.

The release means may be composed of a release lever 42 mounted to the latching means 36. In FIG. 4, the latching means 36 is shown as a pivot latch 44 that pivots about a pivot point 46 and is attached to the release lever 42 at a pivot mount 48. As can be seen in FIG. 4, when the latch is engaged, the pivot latch 44 captures the pivot post 32 of the push handle 18. Since there are usually two pivot posts 32, the release lever 42 and the pivot latch 44 may be connected in parallel.

These components are mounted in or connected to the dispensing base 12 in a manner that permits movement. In particular, the release lever 42 is slidably mounted in the dispensing base and the pivot latch is rotatably mounted to the dispensing base. That is, the release lever 42 is mounted in the dispensing base so the lever is capable of sliding to cause the latching means (including the pivot latch 44) to disengage. When the latching means is reset or re-engaged, the lever is capable of sliding back to its position prior to disengaging the latching means. In FIG. 4, the release lever 42 and pivot latch 44 engaging the pivot post 32 are shown in solid lines. Broken lines are used to show the position of the release lever and pivot latch while disengaged from the pivot post 32. The arrows in FIG. 4 which do not identify particular element are intended to show the general direction of motion of the release lever and pivot latch.

Referring back to FIG. 2, the door 16 may further include latch receptacles 50 located generally opposite the first pivot means 24. These latch receptacles 50 are intended to work in connection with latch elements 52 which may be included in the release lever 42 and may work in conjunction with the latching means 36. The latch elements 52 are desirably an integral part of the latching means and should engage the latch receptacles when the door is in the closed position to keep the door securely closed.

Figure 5:
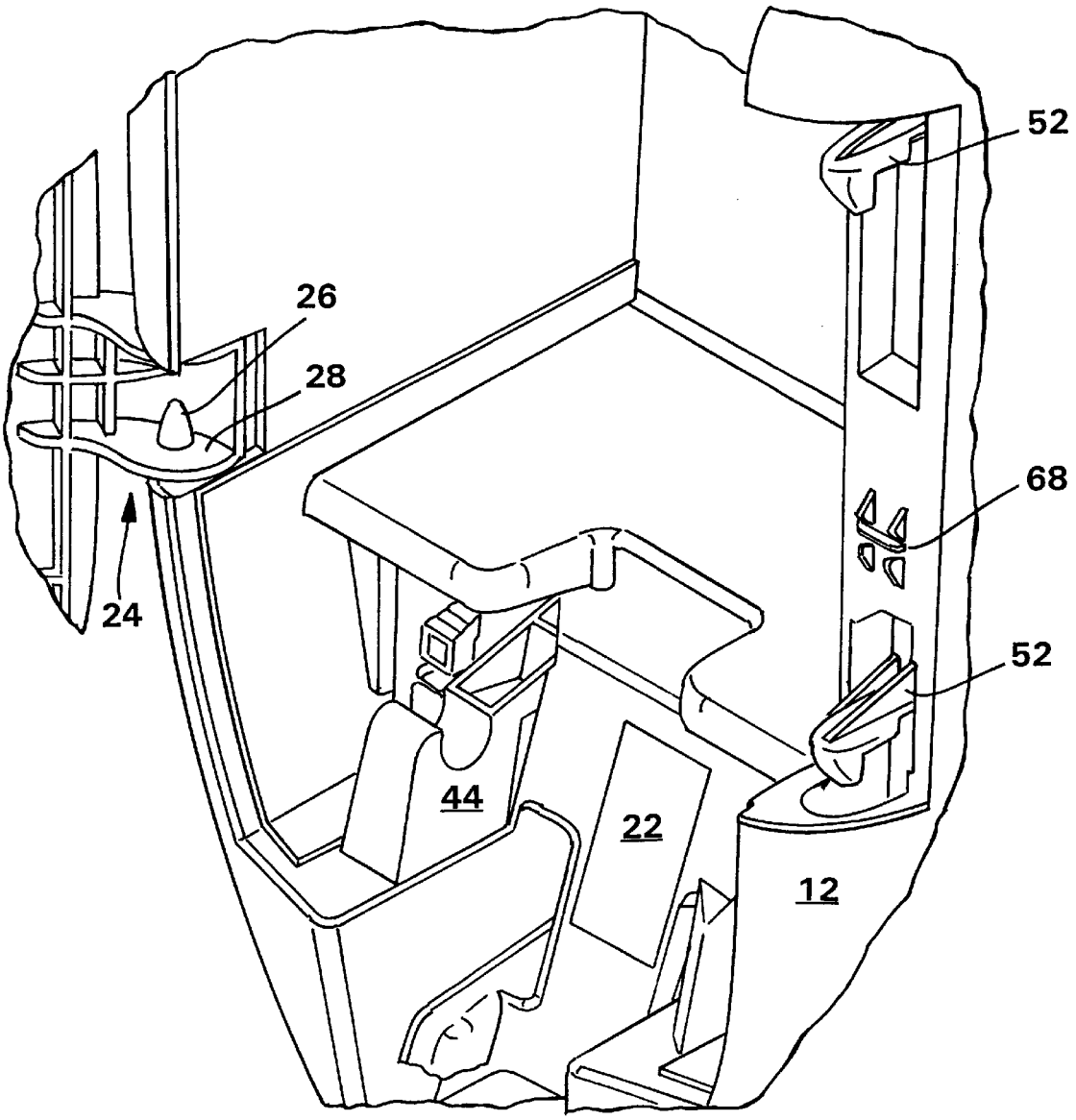
FIG. 5 is a perspective view illustration of an exemplary dispensing system for flowable liquids showing the latching means and latching elements.

FIG. 5 is an illustration which depicts the latch elements 52 in the open or disengaged position. In FIG. 5, it is also possible to see the pivot latch 44 while it is in the open or disengaged position.

FIGS. 6A through 6D are schematic illustrations (not necessarily to scale) showing an embodiment of the invention which includes a return spring and a tab lock so that the latching means (e.g., pivot latch) 44 is held in an unlocked position when the release lever 42 is depressed to disengage the pivot latch 44 and remain in the open or disengaged position until the door 16 is closed.

Figure 6A:
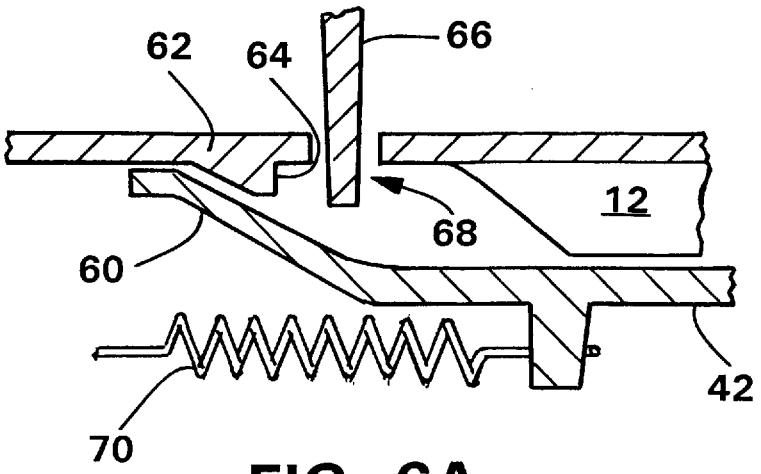
FIGS. 6A, 6B, 6C and 6D are schematic view illustrations of a detail of an exemplary dispensing system for flowable liquids.

FIG. 6A shows a tab lock in the closed or static position. The tab lock is composed of a tab 60 and a detent 62 which has a catch or ledge 64. Desirably, the tab 60 is an integral part of the release lever 42. The tab lock also includes a probe 66 that is part of the door 16. The probe 66 projects through an opening 68 in the dispensing base 12. In the static position, the tab 60 is positioned well below the detent 62. At this position, displacement of a return spring 70 connected to the release lever 42 is minimal.

Figure 6B:
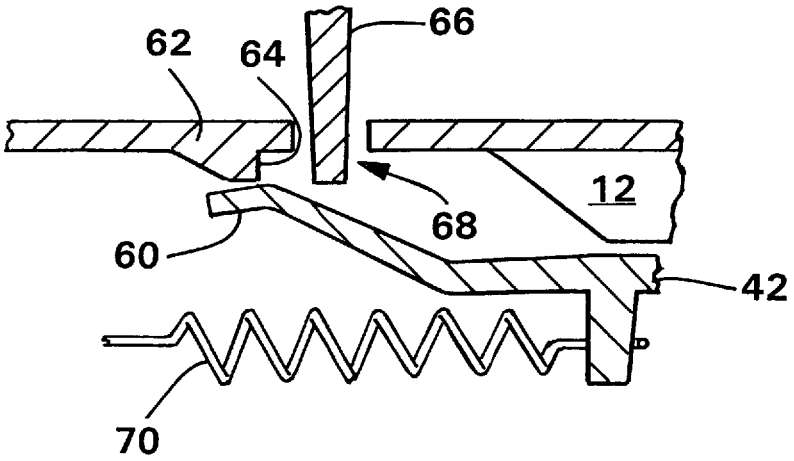

FIG. 6B shows the tab lock as the release lever is depressed to disengage the pivot latch and latch elements. This action causes the tab 60 to travel up and onto the detent 62. The movement of the tab 60 and release lever 42 causes displacement of the return spring 70.

Figure 6C:
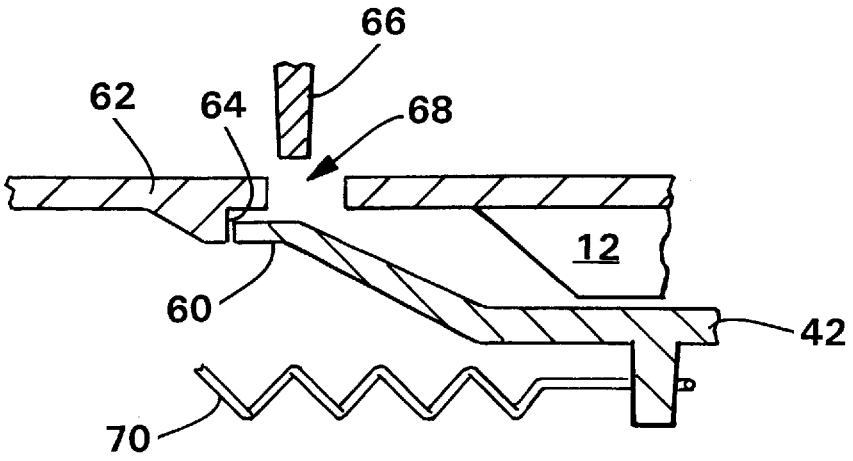

FIG. 6C shows the tab lock with the release lever sufficiently depressed for the dispenser door 16 to open. As is seen in FIG. 6C, opening the door 16 causes the probe 66 to exit the opening 68 thus vacating the space it occupied near the catch or ledge 64 of the detent. The tab 60 is shown locked in place at the detent 62 by the catch or ledge 64. At this position, the return spring 70 is at its maximum displacement. The tab 60, which is part of the release lever 42, also serves to lock the release lever 42 so that the latch means (e.g., pivot latch) 44 and latch elements 52 are held in the open or disengaged position while the dispenser door 16 is open. This arrangement makes it easier for the dispenser door 16 to be closed without interference from the latching means 44 and latch elements 52.

Figure 6D:
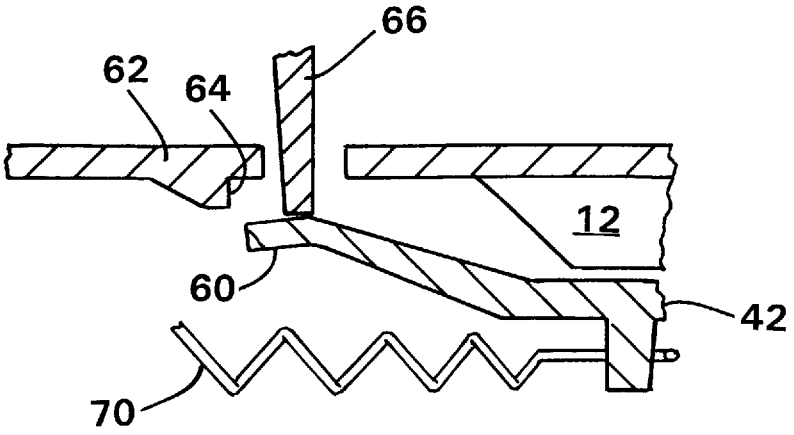

FIG. 6D shows the tab lock as the probe 66 displaces or deflects the tab 60 during the closing of the door 16 so that the tab 60 disengages the catch or ledge 64 of the detent 62 and is drawn back to the static position (see FIG. 6A) by force from the return spring 70.

Figure 7:
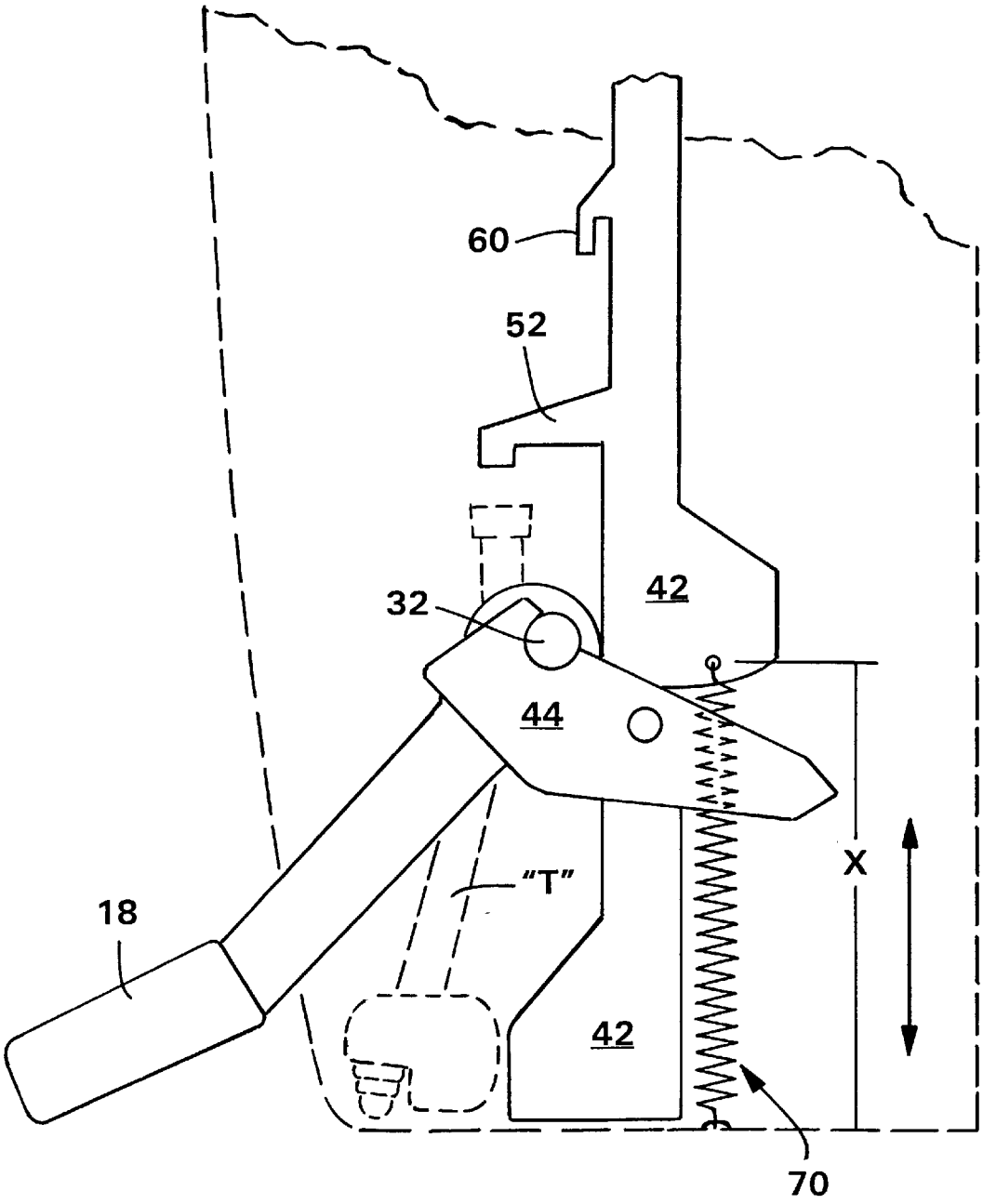
FIGS. 7 and 8 are illustrations of the exemplary dispensing system for flowable liquids showing configurations during use.

FIG. 7 is an illustration of the push handle 18, latching means (e.g., pivot latch) 44 and release lever 42 in position to engage the pivot posts 32 of the push handle 18. Note that the bottom of the release lever is approximately flush with the bottom of the dispensing base (represented by the broken line). However, it is contemplated that the release lever may be configured with respect to the dispensing base in other manners. Also note that the return spring 70 has a length "X". The tube "T" which is part of the pumping mechanism is shown in broken lines between the push handle 18 and the release lever 42 without the pressure plate 22 shown in FIGS. 2, 3 and 5.

Figure 8:
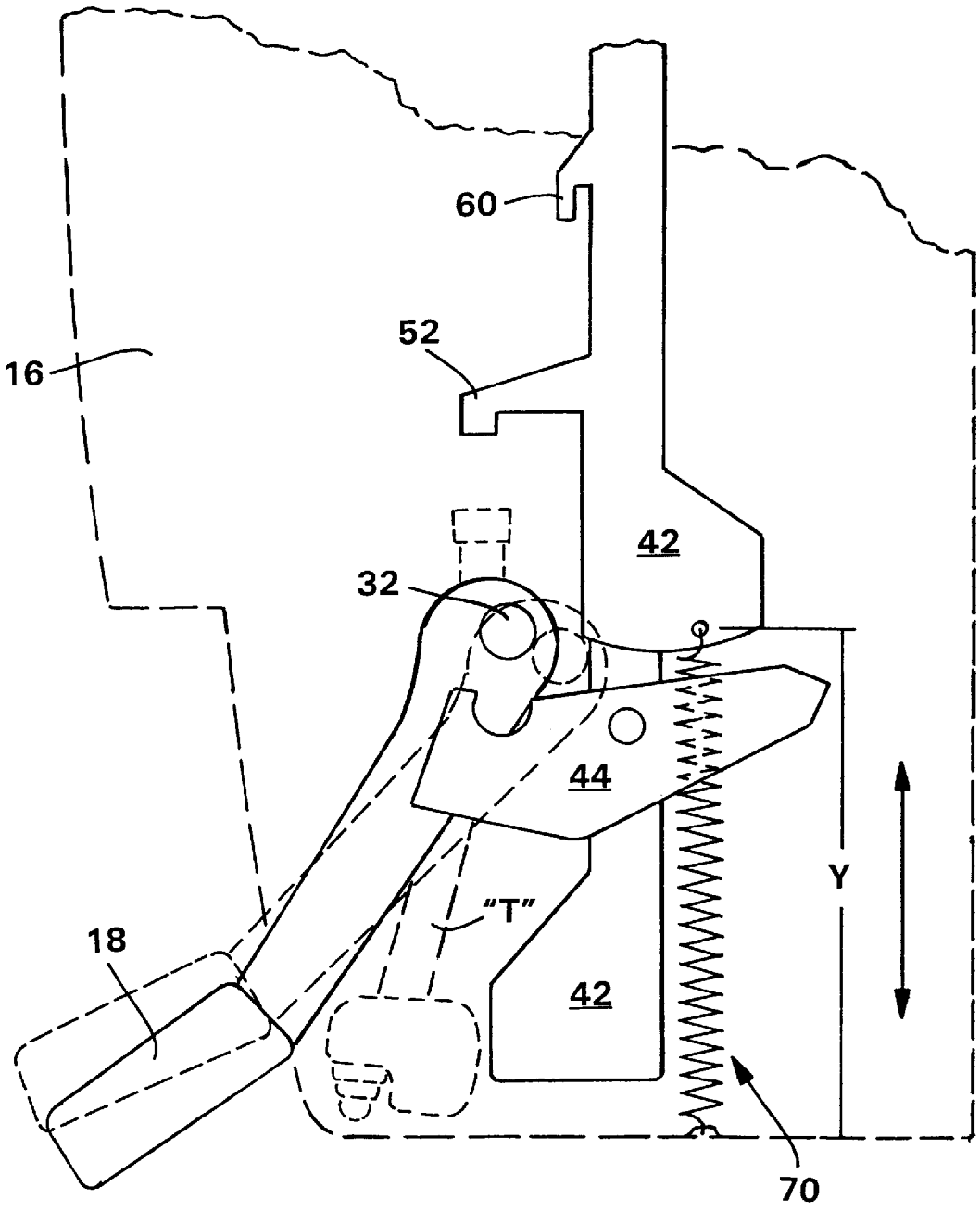

FIG. 8 is an illustration of the push handle 18, latching means (e.g., pivot latch) 44 and release lever 42 in the disengaged position with the door 16 slightly ajar. As can be seen in comparison to FIG. 7, the release lever is displaced upward in the direction of the arrows shown therewith such that the return spring 70 has a length "Y" which is greater than length "X". In addition, the latching means 44 (e.g., pivot latch) rotates to disengage the pivot posts 32 of the push handle 18. As may be seen in the broken line depiction of the push handle 18, the push handle 18 drops slightly during the disengaged position as it is no longer held in place by the pivot latch 44.

Figure 9:
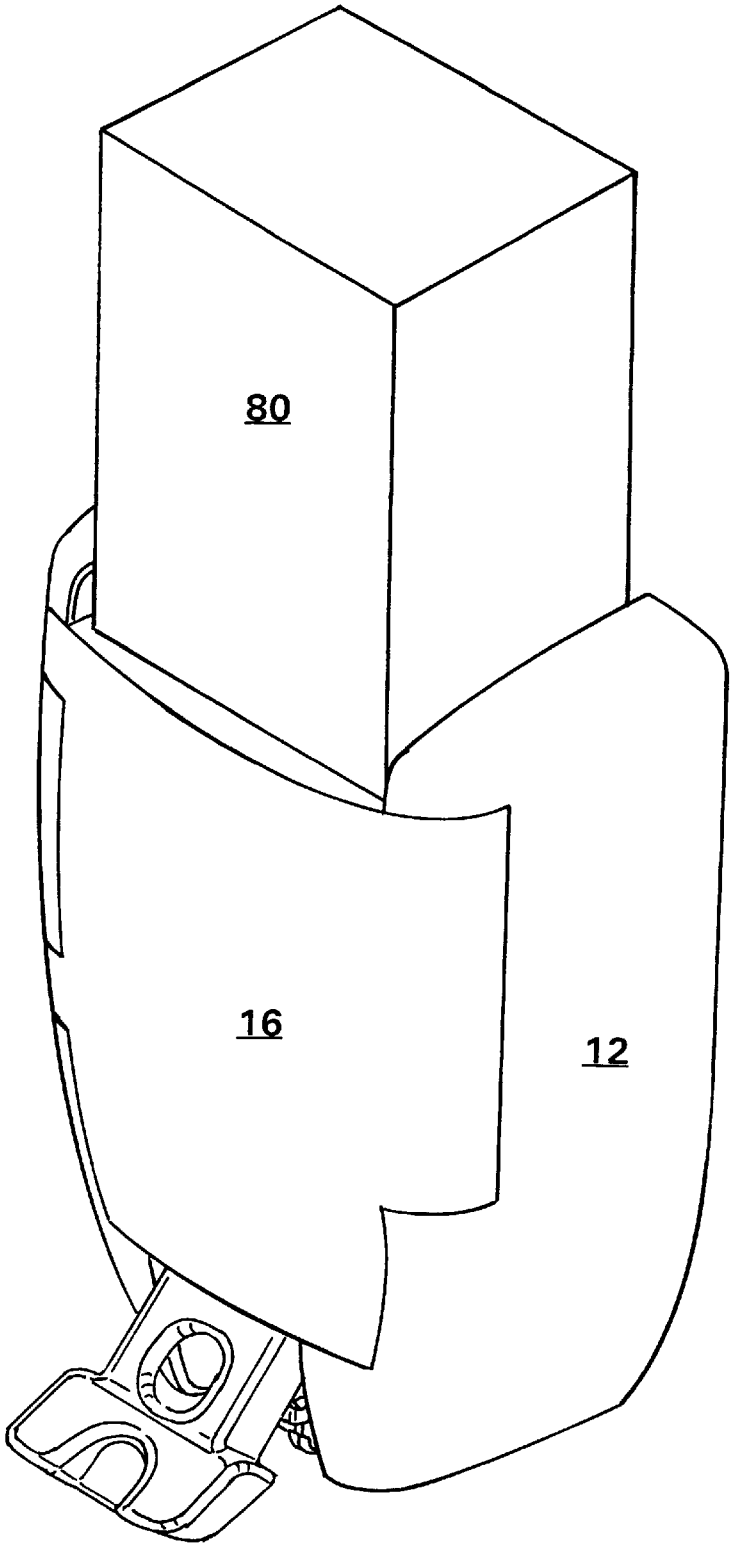
FIG. 9 is an illustration of a feature of the exemplary dispensing system for flowable liquids.

FIG. 9 shows an embodiment of the present invention in which the dispensing base 12 (in cooperation with the door) may be configured to support a refill package beyond one-half the overall height of the refill package. For example, the dispensing base may be configured to support the refill package to three-quarters of the overall height of the refill package or even to the full height of the refill package.

This is an advantage because large capacity dispensers often hold large liquid refill packages that protrude from the base of the dispenser. The protruding part of these packages are typically reinforced with cardboard, paperboard or similar material. If the exterior of these large liquid refill packages are exposed to excessive moisture or are wetted, the reinforcement becomes ineffective and the package may deform and interfere with reliable dispensing. Accordingly, configuring the dispensing base 12 to support a refill package beyond one-half the overall height of the refill package helps prevent the package from deforming and helps ensure reliable dispensing.

Figure 10A:
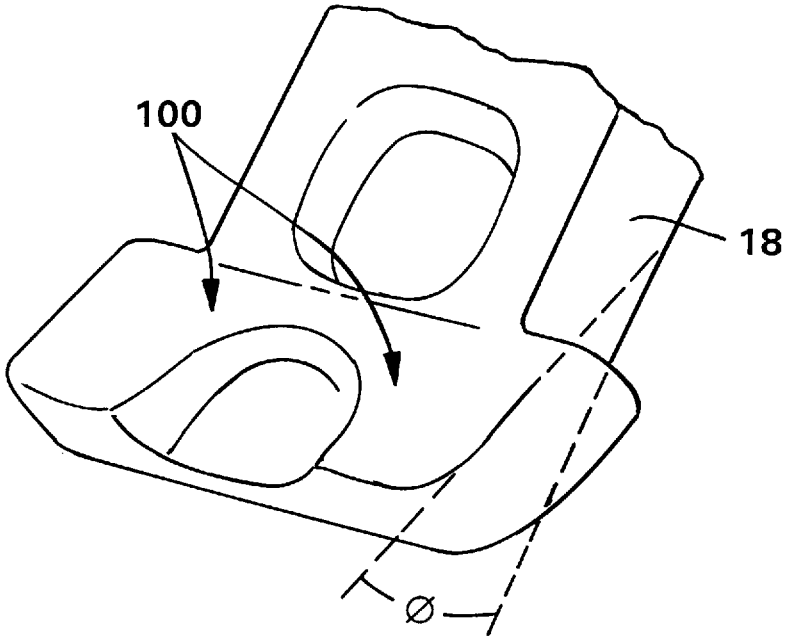
FIGS. 10A and 10B are illustrations of a detail of the push handle and the dispenser during forearm actuation.
Figure 10B:
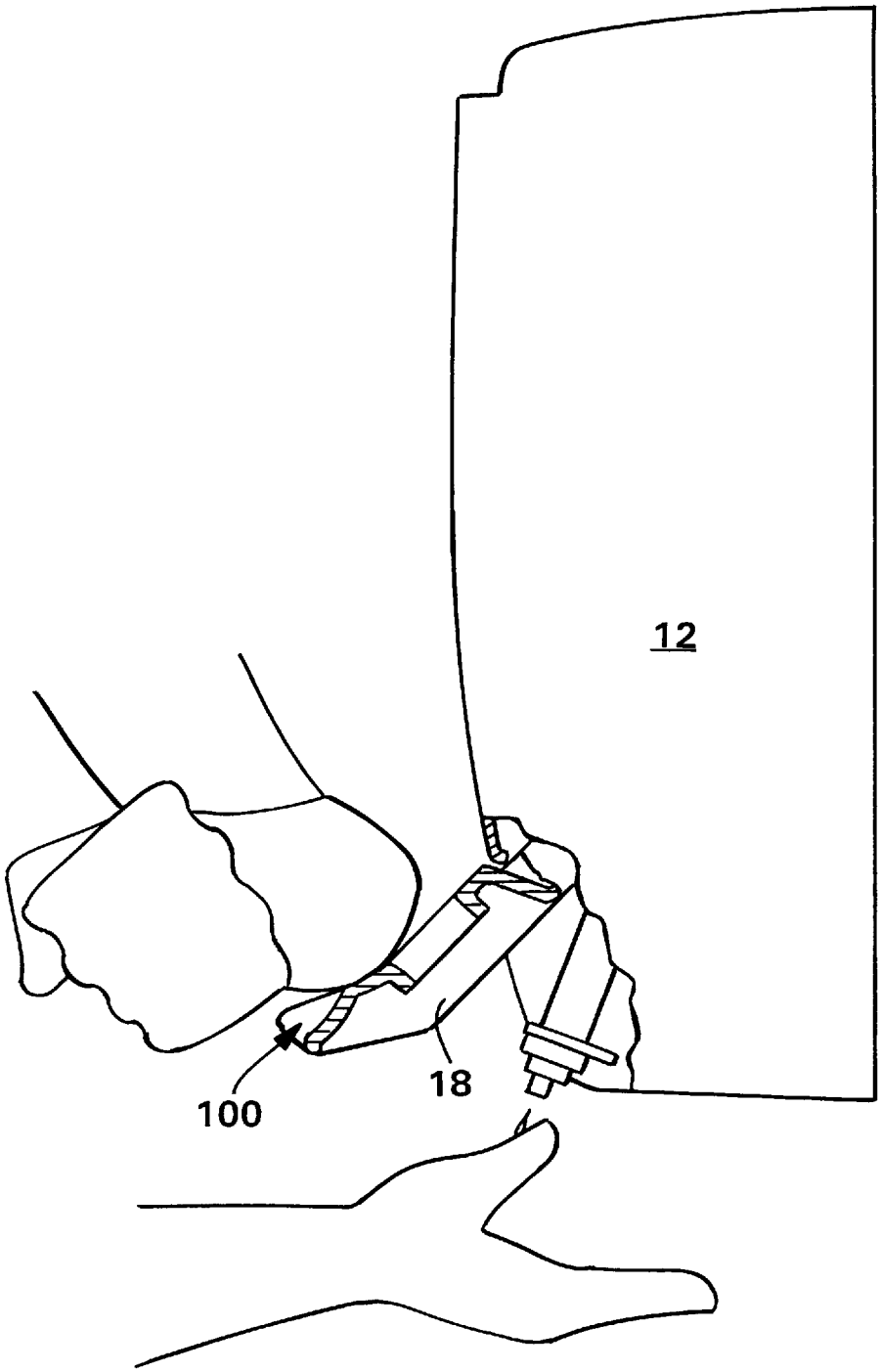

According to the present invention, the push handle may include a discrete push surface. Referring now to FIG. 10A of the drawings, there is shown a portion of the push handle 18 with a first push surface 100 for contact with a user's forearm or elbow or other body part. This discrete push surface 100 may be set at an obtuse angle θ (i.e., greater than 90 and less than 180 degrees)to permit convenient actuation of the dispenser by the elbow or forearm of a user as shown in FIG. 10B. If the push surface 100 is set at an obtuse angle, the angle θ (shown in FIG. 10A) should be sufficient to prevent the forearm from sliding off during dispensing. As an example, the angle θ may range from about 175 degrees to about 145 degrees to provide a crease or break between the plane of the push handle 18 and the plane of the push surface 100. As another example, the angle θ may range from about 170 degrees to about 155 degrees. As yet another example, the angle θ may range from about 165 degrees to about 162 degrees.

Figure 11A:
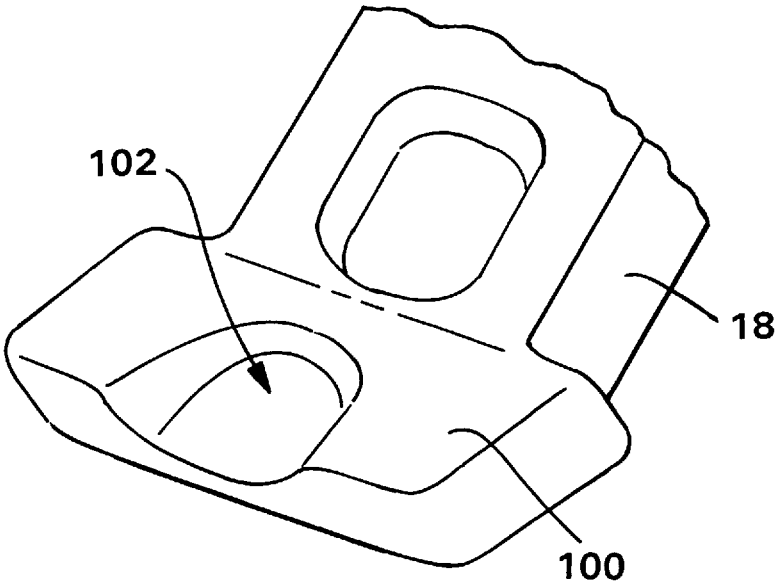
FIGS. 11A, 11B and 11C are illustrations of a detail of the push handle and the dispenser during thumb actuation.
Figure 11B:
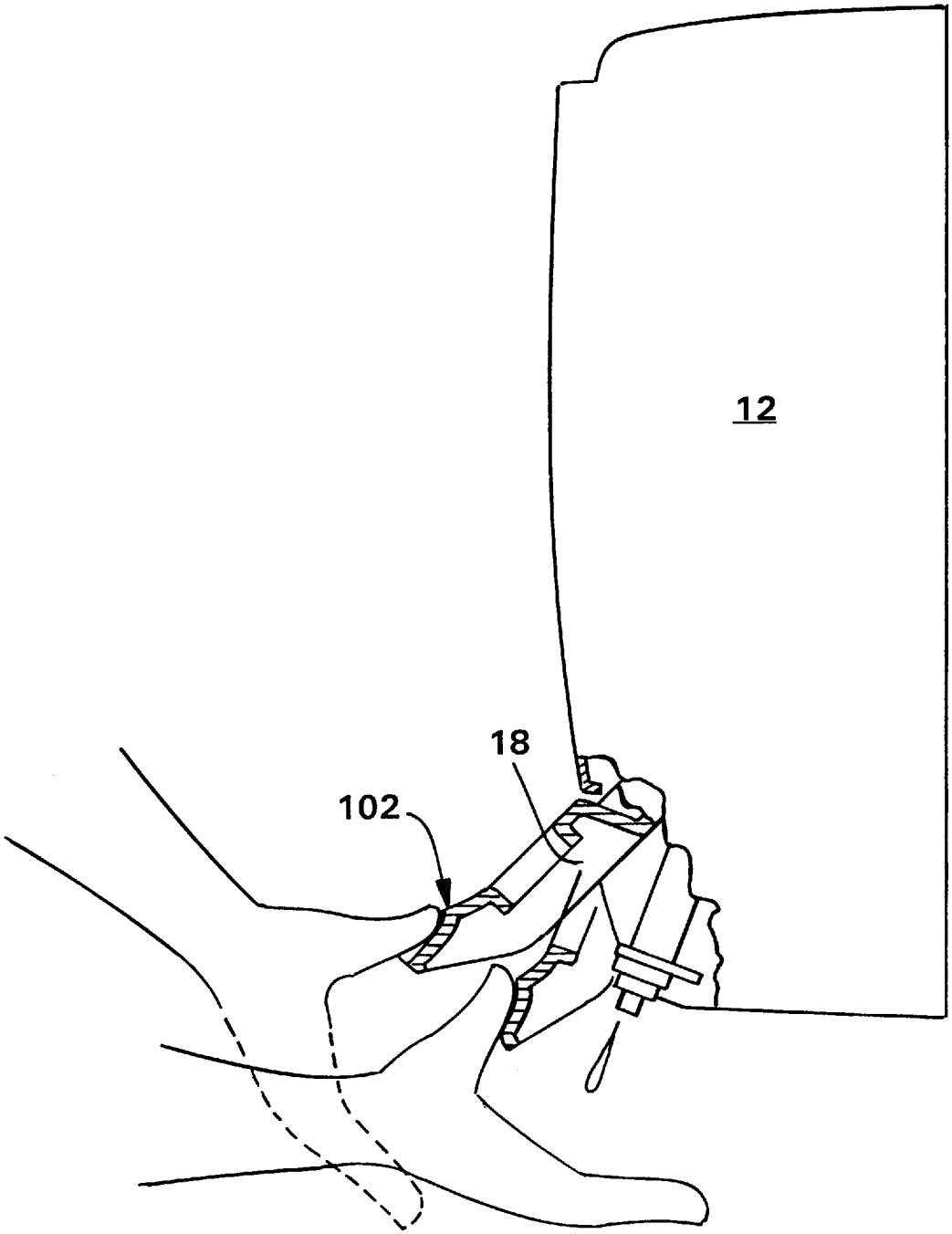

Alternatively and/or additionally, the push surface may include a depression which accommodates a finger or thumb of a user for actuation. Referring now to FIG. 11A, there can be seen a depression 102 that may be located at any point on the push surface 100. Desirably, the depression 102 will divide the push surface 100 into substantially equal portions to permit convenient actuation of the dispenser by the thumb of a user as shown in FIG. 11B during one-handed operation of the dispenser. Generally speaking, the depression 102 is situated at a depth and location so that the user's hand is in position to receive liquid (e.g., liquid soap) during one-handed dispensing. If the thumb of the user was on the plane of the push surface 100, the user's hand would generally be too far away from the outlet of the pump to receive the liquid as it is dispensed. On the other hand, if the push surface 100 were on the same plane and at the same angle as the depression 102, the forearm of a user would tend to slide off the push surface during dispensing.

Figure 11C:
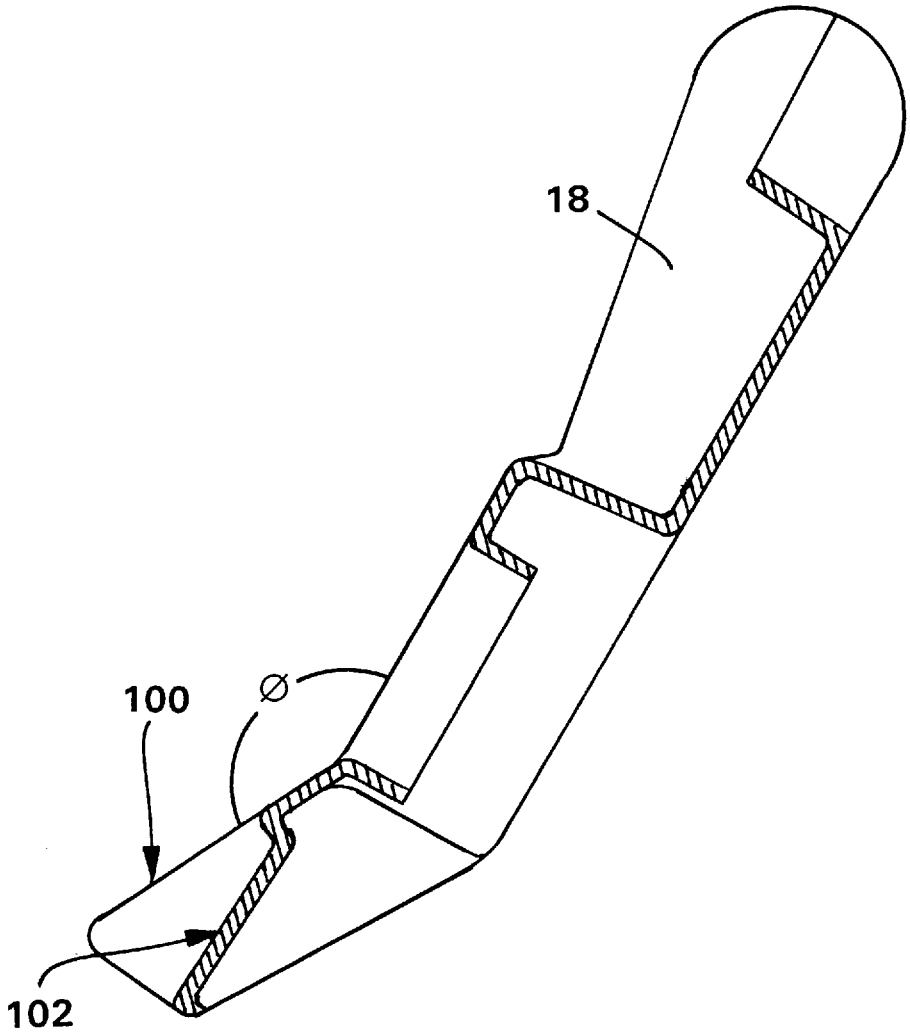

FIG. 11C is a cross-sectional illustration of an exemplary relationship between the push surface 100 and the depression 102 on the push handle 18. Generally speaking, when the push handle 18 is at rest in the dispensing position, the depression 102 or thumb surface may be at the same angle or in the same plane as the push handle. The push surface 100 may be configured so it breaks from the plane of the push handle 18 to form an obtuse angle between about 175 degrees to about 145 degrees to define a depression 102 or thumb surface that is below the plane of the push surface 100. As another example, the angle θ may range from about 170 degrees to about 155 degrees. As yet another example, the angle θ may range from about 165 degrees to about 162 degrees. Of course, other configurations are contemplated and the inventors should not be limited to the specific embodiments described herein.

Figure 12A:
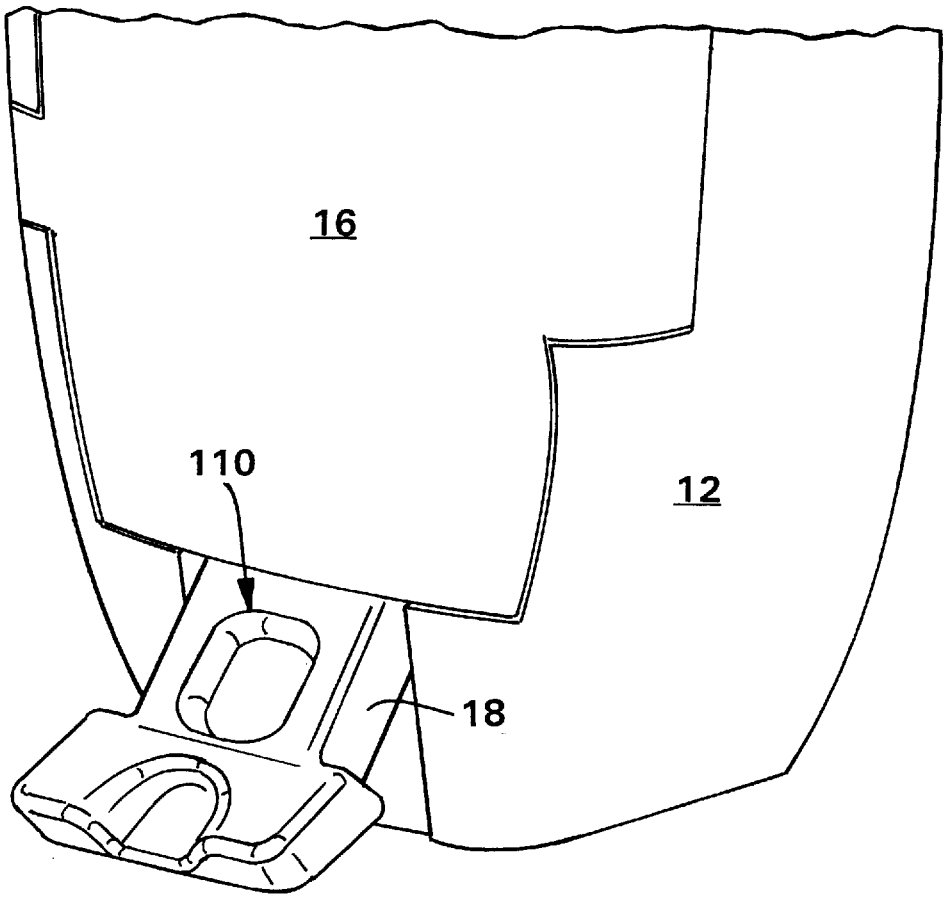
FIGS. 12A and 12B are illustrations of a detail of the push handle.
Figure 12B:
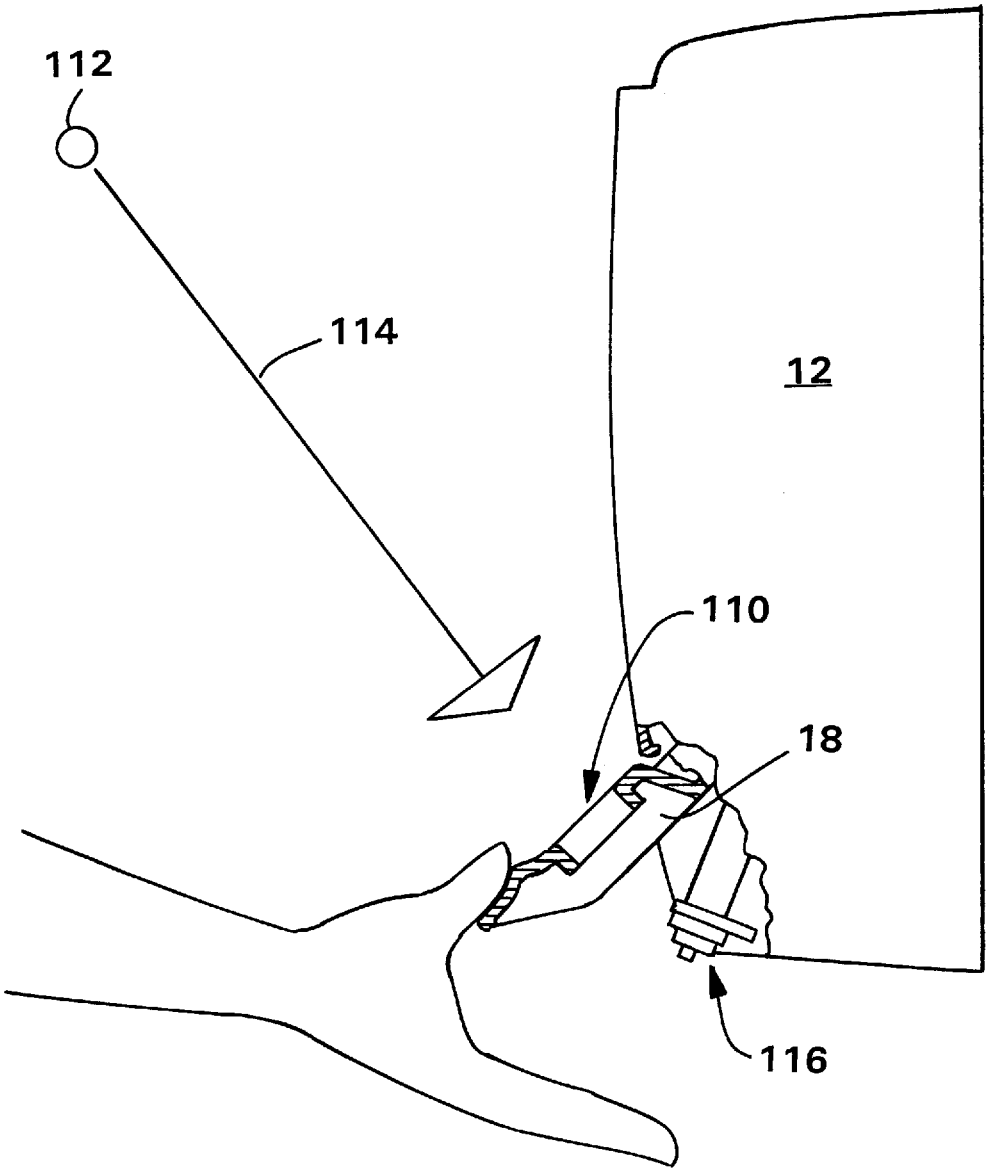

FIGS. 12A and 12B illustrate yet another aspect of the present invention relating to the push handle. Because of the robust latching means which secure the push handle directly to the dispensing base, it is much more practical to extend the length of the push handle to increase the leverage and reduce the force required to pump liquid through the dispenser. One drawback to extending the length of the push handle is that the handle effectively hides the pump nozzle so that a user's view of the liquid being dispensed is obscured. However, as shown in FIG. 12A, the body of the push handle 18 may be configured to define an opening 110 through which a user may view the portion of the dispenser where liquid is dispensed. This feature can be seen in FIG. 12B which is a representation of a user 112 pushing the push handle 18 of a dispenser mounted so that the user 112 have an relatively unobstructed line of sight 114 through the opening 110 to the pump nozzle 116.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A dispensing system for flowable liquids, comprising:

a dispensing base for holding a refill package of a flowable liquid;

a door that is pivotally mounted to the dispensing base by a first pivot means, the door having an open position and a closed position;

a push handle pivotally mounted to the door by a second pivot means;

latching means integral with the dispensing base to pivotally secure the push handle at the second pivot means when the door is closed so that the door is held secure in the closed position and the push handle may be used for dispensing; and release means for disengaging the push handle from the latch means so that the door may be moved to its open position.

2. The dispensing system of claim 1, wherein the door further comprises latch receptacles located generally opposite the first pivot means and wherein the latching means further comprise latching elements integral with the dispensing base to engage the latch receptacles when the door is in the closed position.

3. The dispensing system of claim 1, wherein the latching means comprise a pivot latch.

4. The dispensing system of claim 1, wherein the release means comprise a release lever mounted to the latching means.

5. The dispensing system of claim 1, wherein the first pivot means comprise pivot posts and mounting holes.

6. The dispensing system of claim 1, wherein the second pivot means comprise pivot posts and mounting holes.

7. The dispensing system of claim 4, wherein the release means further comprise a return spring and a tab lock so that the latching means are held in an unlocked position when the release lever is depressed and remain in the unlocked position until the door is closed.

8. The dispensing system of claim 1, wherein the dispensing base supports the refill package beyond one-half the overall height of the refill package.

9. The dispensing system of claim 1, wherein the push handle further comprises a discrete push surface.

10. The dispensing system of claim 9, wherein the push surface is set at an angle to permit actuation by the elbow or forearm of a user and wherein the push surface includes a depression which accommodates a finger or thumb of the user for actuation.

11. The dispensing system of claim 1, wherein the body of the push handle defines an opening through which a user may view the portion of the dispenser where liquid is dispensed.

12. A dispensing system for flowable liquids, comprising:

a dispensing base for holding a refill package of a flowable liquid;

a door that is pivotally mounted to the dispensing base by a first pivot means, the door having an open position and a closed position and at least one latch receptacle located generally opposite the first pivot means;

a push handle pivotally mounted to the door by a second pivot means;

latching means integral with the dispensing base, the latching means comprising at least one pivot latch to pivotally secure the push handle at the second pivot means when the door is closed and at least one latching element integral with the dispensing base to engage the latch receptacle so that the door is held secure in the closed position and the push handle may be used for dispensing; and release means for disengaging the push handle from the latch means so that the door may be moved to its open position.

13. The dispensing system of claim 12, wherein the release means comprise a release lever mounted to the latching means.

14. The dispensing system of claim 12, wherein the first pivot means comprise pivot posts and mounting holes.

15. The dispensing system of claim 12, wherein the second pivot means comprise pivot posts and mounting holes.

16. The dispensing system of claim 13, wherein the release means further comprise a return spring and a tab lock so that the latching means are held in an unlocked position when the release lever is depressed and remain in the unlocked position until the door is closed.

17. The dispensing system of claim 12, wherein the dispensing base supports the refill package beyond one-half the overall height of the refill package.

18. The dispensing system of claim 12, wherein the push handle further comprises a discrete push surface that is set at an angle to permit actuation by the elbow or forearm of a user and wherein the push surface includes a depression which accommodates a finger or thumb of the user for actuation.

19. The dispensing system of claim 12, wherein the body of the push handle defines an opening through which a user may view the portion of the dispenser where liquid is dispensed.

20. A dispensing system for flowable liquids, comprising:

a dispensing base for holding a refill package of a flowable liquid;

a door that is pivotally mounted to the dispensing base by a first pivot means, the door having an open position and a closed position and at least one latch receptacle located generally opposite the first pivot means;

a push handle pivotally mounted to the door by a second pivot means;

latching means integral with the dispensing base, the latching means comprising at least one pivot latch to pivotally secure the push handle at the second pivot means when the door is closed and at least one latching element integral with the dispensing base to engage the latch receptacle so that the door is held secure in the closed position and the push handle may be used for dispensing; and release means for disengaging the push handle from the latch means so that the door may be moved to its open position, the release means comprising a release lever mounted to the latching means in combination with a return spring and a tab lock so that the latching means are held in an unlocked position when the release lever is depressed and remain in the unlocked position until the door is closed.

* * * * *